US005816982A

United States Patent [19]

Croushore

[11] Patent Number: 5,816,982

[45] Date of Patent: Oct. 6, 1998

[54] SWIMMER'S EXERCISING METHOD AND APPARATUS

[76] Inventor: Bruce J. Croushore, P.O. Box 1333, Santa Rosa Beach, Fla. 32459

[21] Appl. No.: 868,940

[22] Filed: Jun. 4, 1997

[51] Int. Cl.[6] ..... A63B 31/00

[52] U.S. Cl. ..... 482/55

[58] Field of Search ..... 422/55, 129

[56] References Cited

U.S. PATENT DOCUMENTS

| | | | |
|---|---|---|---|
| 620,453 | 2/1899 | Hendrickson | 482/129 |
| 704,840 | 7/1902 | Korth | 482/129 |
| 726,095 | 4/1903 | Nightingale | 482/129 |
| 781,683 | 2/1905 | Shepherd | 482/129 |
| 1,112,214 | 9/1914 | Caines | 482/129 |
| 4,962,923 | 10/1990 | Earner | 482/55 |

*Primary Examiner*—Lynne A. Reichard
*Attorney, Agent, or Firm*—Beveridge, DeGrandi, Weilacher & Young, LLP

[57] ABSTRACT

Stationary swimming exercises are conducted with a lightweight, compact and portable apparatus which includes a manually collapsible bag formed of flexible sheet material for containing a volume of water, and a tether line which has a rear portion connected to the bag and a forward portion which is connectable to a swimmer. To facilitate filling and draining, the bag has an elongated opening provided with an elongated closing member. According to the method, the bag is filled with pool water by a swimmer standing in the pool, the bag opening is closed, the bag is heaved onto the pool deck, the tether line is connected to the bag and the swimmer, and the swimmer conducts his or her stationary swimming exercises. After exercising, the bag is opened, drained and collapsed to form a lightweight, compact and portable unit.

22 Claims, 2 Drawing Sheets

SWIMMER'S EXERCISING METHOD AND APPARATUS

BACKGROUND OF THE INVENTION

This invention relates to a lightweight, compact and portable apparatus for stationary swimming exercise, and to a method of using such an apparatus.

Among the many types of physical fitness exercises, it is widely recognized that swimming has particular benefits. It is an aerobic exercise which improves and maintains muscle tone and cardiovascular function without the impact and stress which are associated with other types of exercise. However, many swimming pools are not suitable for lap swimming because the pools are too short or irregularly shaped or because separate lane markers are not provided to isolate the lap swimmers from other swimmers in the pool.

To overcome these problems, various types of tethering systems have been proposed to restrain swimmers without interfering with the arm and leg movements which are normally performed while swimming. In such systems, the forward end of a tether line is connected to the swimmer. The rear end of the tether line is usually connected to poolside fixtures such as stationary ladders, brackets, or other objects. Suitable fixtures are not always available and, when available, they often are not suitably located with respect to the area of the pool where stationary swimming exercises may be conducted.

In U.S. Pat. No. 4,962,923, it is proposed to fill a large container with water, place the container on the pool deck, attach a flexible post to the container, and attach a tether line to the post. The container is rigid and is not manually collapsible. Therefore, the use of such a container and post is unsuitable for situations where the swimmer, typically a business traveller, uses many different hotel and motel pools. Such an arrangement is also unsatisfactory for pools which do not have suitable storage facilities for the container.

The present invention provides an apparatus for stationary swimming exercises which is suitable for use by anyone, regardless of the configuration of the pool facility, the availability of storage space, or other factors. It can be used in short pools, long pools, pools with irregular deck configurations, and in pools with or without conveniently located poolside fixtures. There is no limitation as to the type of pool with which the present invention can be used.

The present invention utilizes a manually collapsible container such as a flexible bag which is filled with water from the pool, placed on the pool deck, and connected to the rear end of the swimmer's tether line. After exercising, the swimmer can drain the water back into the pool, collapse the bag, and fold the bag so that it will fit easily into a suitcase, a gym bag, or other container where it can be kept and carried until the next swimming exercise session.

The invention is particularly uncomplicated and easy to use. It can be made of standard, commercially available components including a waterproof bag which has a rollable closure at one end and grommets at its opposite end, elastic cording, woven webbing, and standard detachable connectors. The method according to the invention is particularly convenient and it offers the user the substantial advantages of being able to conduct swimming exercises in any pool.

SUMMARY OF THE INVENTION

In one respect, the invention involves a lightweight, compact and portable apparatus for stationary swimming exercises, including a manually collapsible bag formed of flexible sheet material for containing a volume of water, and a tether line with a forward portion which is connectable to a swimmer and a rear portion which is connected to the bag. The collapsible bag has at least two opposed panels which form an interior chamber for holding a quantity of water, an opening for filling the chamber with water and for draining water from the chamber, and closing means for closing the opening to prevent water from flowing through the opening when the chamber contains water.

Preferably, the bag has a forward end provided with two laterally spaced connection points. A bridle has its opposite ends connected to the connection points, and the tether line is connected to the bridle by a detachable coupling. The detachable coupling has a slidably adjustable connection to the tether line to permit adjustments in the length of the tether line.

The apparatus preferably is sufficiently compact so that, when the bag is collapsed, the apparatus has a volume which is no greater than 0.25 cubic feet; and, it is lightweight in the respect that, when the bag is dry and empty, the apparatus has a weight which is no greater than 32 ounces.

The bag is preferably formed of a material which has a higher coefficient of static friction when it is wet than when it is dry.

The bag opening is preferably elongated, and the closing means includes an elongated member which is attached to one of the panels and extends along the opening. A preferred elongated member is attached to one of the panels and extends transversely across the bag. The bag has a rollable portion near the opening which is rollable around the elongated member to form a closure roll which closes the opening, and a securing means is provided for preventing the closure roll from unrolling. A disclosed securing means is a detachable coupling which has two separable parts which are connected to opposite ends of the transverse member.

In another respect, the invention is a lightweight, compact and portable apparatus for stationary swimming exercises comprising a manually collapsible bag for containing a volume of water. The bag is formed of at least two panels of flexible sheet material which are opposed to each other and form an interior chamber for holding a quantity of water. An elongated opening is provided for filling the chamber with water and for draining water from the chamber. To prevent water from flowing through the opening when the chamber contains water, the bag is provided with a closing means which includes an elongated member which is attached to one of the panels and extends along the opening.

In still another respect, the invention is a method of conducting tethered swimming exercise utilizing a manually collapsible bag which has an interior chamber for containing a volume of water, and an opening for filling the chamber with water. The method includes the following steps:

- immersing the bag in a swimming pool so that water from the swimming pool flows through the opening and into the chamber of the bag;
- closing the opening of the bag to retain the water in the chamber;
- removing the bag from the pool;
- attaching spaced portions of a tether line to the bag and to a swimmer;
- swimming in the pool while being restrained by the tether line and the bag;
- draining the water from the bag, and;
- collapsing the bag to facilitate its portability.

Preferably the bag opening is elongated, and the step of closing the bag is performed with an elongated closing member.

DESCRIPTION OF THE PREFERRED EMBODIMENTS

Figure 1:
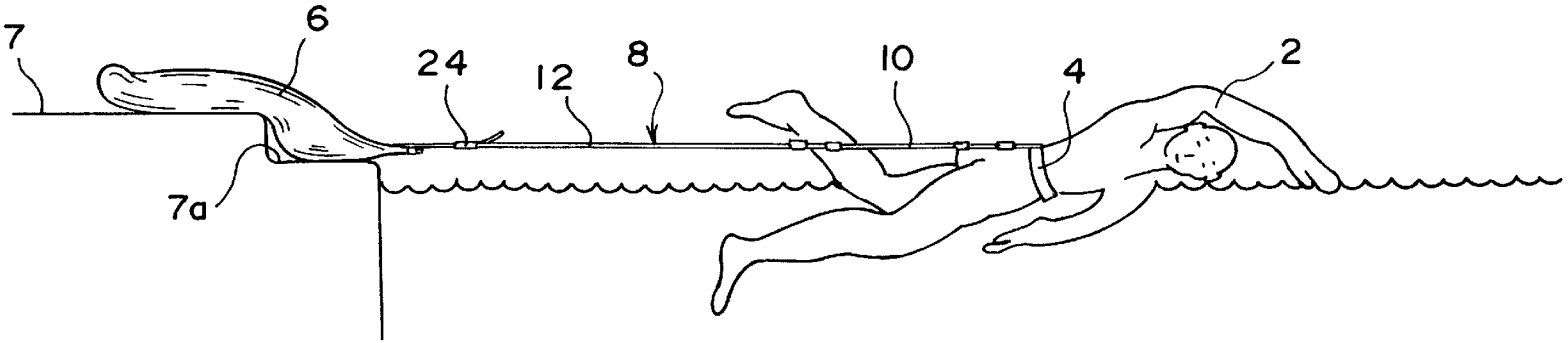
FIG. 1 shows a swimmer who is using the invention to conduct stationary swimming exercises.

As shown in FIG. 1, a swimmer 2 is conducting stationary swimming exercises using the apparatus of the invention. The swimmer is using a conventional crawl stroke, while he is restrained from forward movement by the apparatus of the invention.

The apparatus includes an adjustable belt 4 which encircles the swimmer's waist, a stationary weight in the form of a bag 6 which is filled with water, and a tether line 8 which is under tension and connects the swimmer's belt to the bag 6. The bag lies on the pool deck 7 and it is flexible so that, when the deck has a gutter or stepped surface 7*a* near its edge as shown in FIG. 1, the bag will conform to, contact and be supported by both surfaces 7 and 7*a*.

Figures 3, 4:
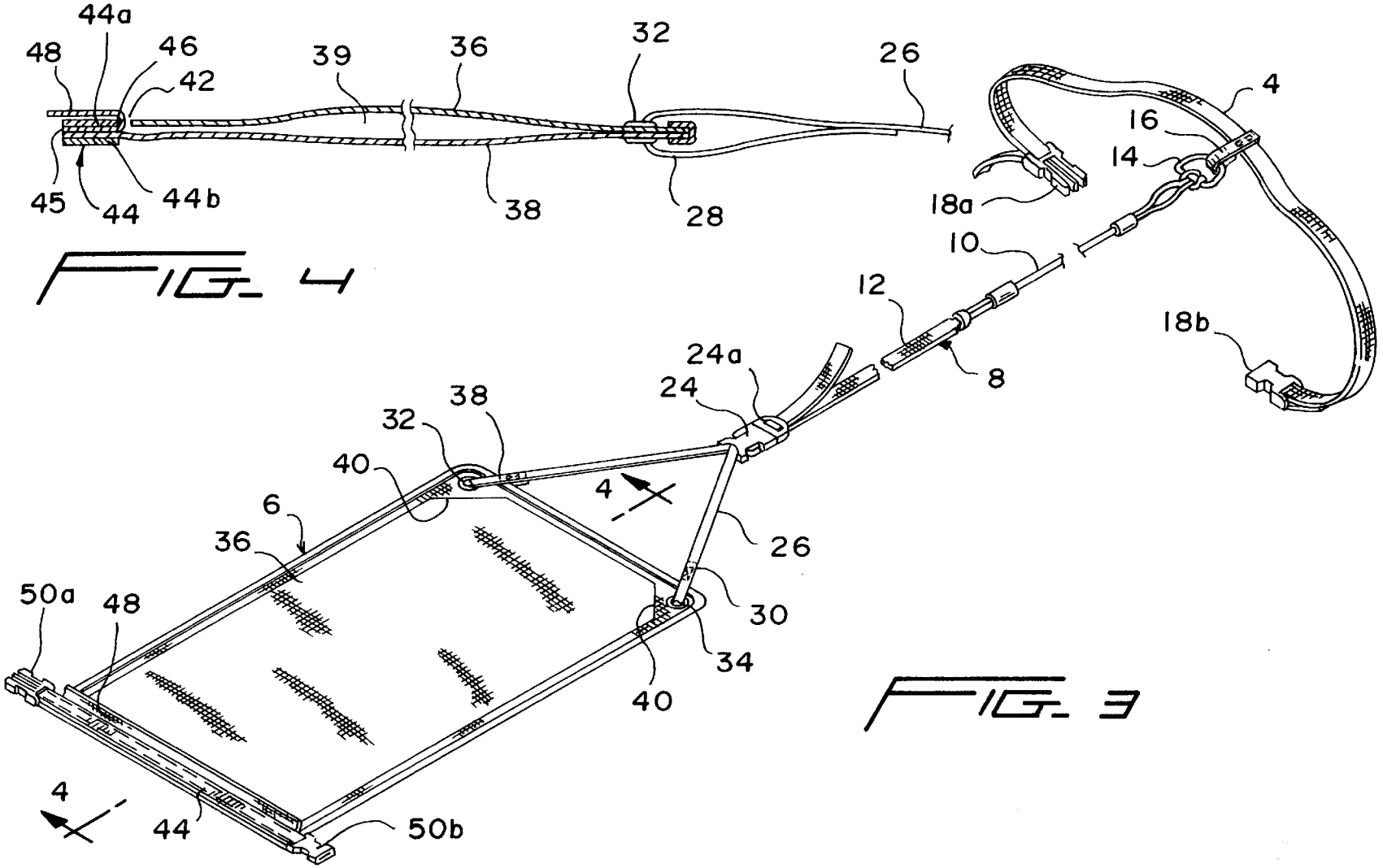
FIG. 3 is a perspective view showing the complete apparatus according to the invention, with the bag in its empty and collapsed condition.
FIG. 4 is a sectional view of a bag and a portion of a bridle connected thereto in accordance with the invention, as seen along the line 4—4 in FIG. 3.

As shown in FIG. 3, the tether line 8 includes an elastic cord portion 10 and an unstretchable web portion 12. The elastic cord portion may be identical to the safety cords used by surfers and snowboarders, wherein loops are provided at both ends of the cord. The swimmer's waist belt 4 has interfitting members 18*a* and 18*b* of a detachable coupling at its opposite ends. An adjustable sliding connection is provided between the belt 4 and the coupling member 18*a* to permit adjustments in the length of the belt so that it will fit securely and comfortably around the swimmer's waist.

The loop at the forward end of the elastic cord 10 is affixed to the swimmer's belt 4 by a ring 14 on a fabric loop 16. The rear end of the tether line 8 is connected to the bag 6 by a detachable coupling 24 and a bridle 26. Coupling 24 has two coupling members 24*a* and 24*b* which are substantially identical to the coupling members 18*a* and 18*b* of the swimmer's waist belt. Loops 28 and 30 formed in the ends of the bridle 26 pass through grommets 32 and 34 in the bag to permanently connect the bridle to the bag. The grommets provide secure transversely spaced connecting points at opposite corners of the forward end of the bag 6. The coupling member 24*a* is slidably but lockably connected to the web portion 12 of the tether line 8, thus providing a convenient means for varying the effective length of the tether line 8 so it will be appropriate for the pool facility.

As shown in FIG. 4, the bag is formed of two panels 36 and 38 of flexible coated sheet material which form an interior chamber 39. Preferably the material is a lined nylon or vinyl fabric which has a higher coefficient of static friction when it is wet than when it is dry. The interior surfaces of these panels are preferably covered with a thermoplastic layer which is heat sealed around the front and side edges of the bag. The seal also extends diagonally in the areas indicated by 40 in FIG. 3 so that the penetration of the fabric by the grommets 32 and 34 will not impair the watertight integrity of the bag. The fabric does not have to be entirely waterproof. A small amount of seepage of water through the fabric is desirable because the wet fabric has a higher coefficient of static friction than the dry fabric, thus increasing its resistance to slipping on the pool deck. Any leakage of water onto the deck is harmless because pool decks are normally sloped so that any water will flow from the deck back into the pool.

As shown in FIG. 4, an elongated opening 42 is provided between the upper and lower panels 36 and 38 at the rear end of the bag. This opening is used for filling the chamber with water prior to use, and for draining water from the chamber after the device has been used.

Figure 2:
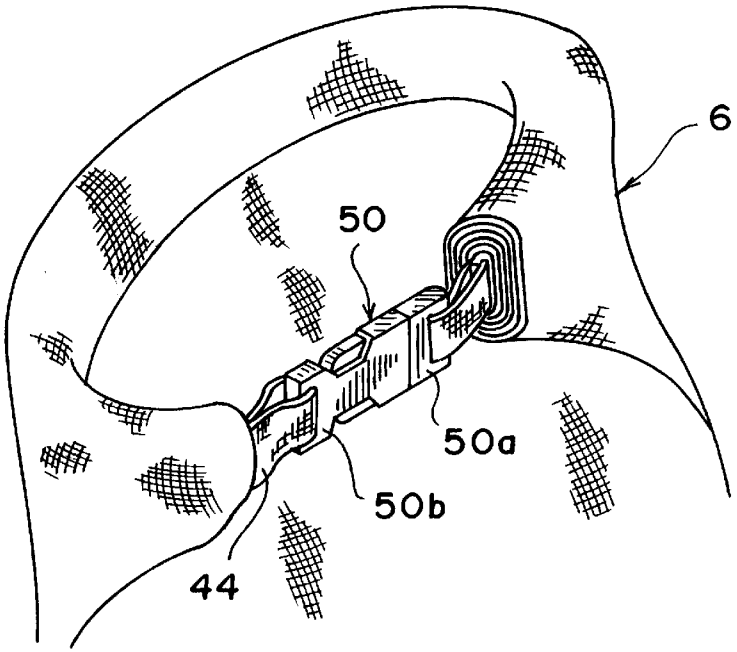
FIG. 2 is a perspective view showing the rear end of a bag which is utilized in connection with the invention, showing the closure roll which closes the rear end of the bag in a preferred embodiment of the invention.

The opening 42 is preferably but not necessarily closed by rolling the portion of the bag, near the opening, around an elongated transverse closing member to form a closure roll which closes the opening. A preferred transverse member is a web fabric belt 44 which, as shown in FIG. 3, is attached to the rear portion of the lower panel 36. As shown in FIG. 4, the rear portion of the lower panel 38 is folded upon itself at 45, sandwiched and sewn between two fabric webs 44*a* and 44*b* which together constitute the belt, and then folded again at 46 to form a flap 48 which overlies the belt 44. To close the bag after it has been filled with water, the rear portion of the bag is rolled around the belt 44 as shown in FIG. 2. To prevent the roll from unrolling, the opposite ends of the belt are provided with mating elements 50*a* and 50*b* of a detachable coupling 50. The coupling 50 is a buckle which is identical to the coupling 18*a*, 18*b* shown in FIG. 3 and the coupling 24 shown in FIG. 4. FIG. 2 shows the rear end of the bag when the elements 50*a* and 50*b* of coupling 50 are connected together.

Tethered swimming exercises according to the invention are performed by immersing the bag 6 in a swimming pool so that water from the pool will flow into the chamber 39 through the opening 42. The amount of water admitted into the bag will depend on the swimmer's weight and strength. Five gallons of water weighs 40 pounds and is adequate to restrain a 200 pound swimmer of average strength. The end of the bag is rolled around the belt 44 to close and seal the opening 42, and the opposite ends of the belt are connected together by connecting the coupling elements 50*a* and 50*b*, thus preventing the closure roll from unrolling. The bag 6 is heaved up from the pool and laid on the pool deck. The rear end of the tether line 8 is attached to the bag, and the forward end of the tether line is attached by the belt 4 to the swimmer. The swimmer 2 then swims in the pool as shown in FIG. 1 while being restrained by the filled bag 6 and the tether line 8. Since the bag material has a sufficiently high coefficient of static friction, there is no tendency for the bag 6 to slip on the pool deck. The resistance to slippage is even greater when the bag is wet because, in this condition, it has a higher coefficient of static friction than when it is dry. At the conclusion of the exercise session, the coupling 50 is uncoupled, the closure roll is unrolled, and the water is drained from the bag into the pool. The bag can be more thoroughly gravitationally drained by suspending it from the bridle 26. The bag is then collapsed until it is flat. In this condition, the entire apparatus is very lightweight, compact and readily portable.

The bag 6 preferably is about three feet long and 1.5 feet wide. A bag of this size is capable of holding at least five gallons of water. When the bag is dry, empty and collapsed, the entire apparatus has a weight which is no greater than 32 oz., and a volume which is no greater than 0.25 cubic feet.

Persons familiar with the art will recognize that the invention may be practiced in many ways other than those disclosed in this specification. The bag can have different sizes and shapes. It can be made of different materials, and the connection between the tether line and the bag can be by means other than the disclosed bridle arrangement. Suitable closures for elongated openings can be slide fasteners such as zippers, flaps of hook and loop material such as Velcro, seals of the type used on Zip-lock brand bags, or other elongated closures. A round closure with a screw cap can be provided. The tether line can be a rope, which can be either elastic or inelastic. The forward end of the tether line can be connected to the swimmer by various types of harnesses and arrangements which are the subject of numerous patents found in the prior art.

In view of the many ways the invention can be practiced, it is emphasized that the invention is not limited only to the embodiments disclosed herein, but embraces variations and modifications which are within the spirit of the following claims.

I claim:

1. A lightweight, compact and portable apparatus for stationary swimming exercises, comprising:

a manually collapsible bag which is formed of flexible sheet material for containing a volume of water;

a tether line having a forward portion which is connectable to a swimmer and a rear portion which is connected to said bag;

said collapsible bag having two panels which are made of a rollable material, said two panes being opposed to each other and forming an interior chamber for holding a quantity of water, an opening for filling the chamber with water and for draining water from the chamber, and closing means for closing said opening to prevent water from flowing through said opening when said chamber contains water;

said bag being collapsible to a flat configuration in which said two parallel panels are substantially contiguous and substantially parallel to each other; said bag, when collapsed, being foldable to fit into a suitcase or other container.

2. A lightweight, compact and portable apparatus according to claim 1 wherein said bag has a forward end to which said tether line is connected, said forward end of the bag having two laterally spaced connection points to which said tether line is connected.

3. A lightweight, compact and portable apparatus according to claim 2 having a bridle to which said tether line is connected, said bridle having opposite ends connected to said connection points.

4. A lightweight, compact and portable apparatus according to claim 3 having a detachable coupling for connecting the tether line to the bridle.

5. A lightweight, compact and portable apparatus according to claim 4 wherein the detachable coupling has a slidably adjustable connection to the tether line to permit adjustments in the length of the tether line.

6. A lightweight, compact and portable apparatus according to claim 1 wherein, when said bag is collapsed, said apparatus has a volume which is no greater than 0.25 cubic feet.

7. A lightweight, compact and portable apparatus according to claim 1 wherein, when said bag is dry and empty, said apparatus has a weight which is no greater than 32 ounces.

8. A lightweight, compact and portable apparatus according to claim 1 wherein the bag is formed of a material which has a higher coefficient of static friction when it is wet than when it is dry.

9. A lightweight, compact and portable apparatus according to claim 1 wherein said closing means includes a transverse member which is attached to one of said panels and extends transversely across the bag, said bag having a rollable portion near said opening which is rollable around said member to form a closure roll which closes said opening.

10. A lightweight, compact and portable apparatus according to claim 9 including securing means for preventing said closure roll from unrolling.

11. A lightweight, compact and portable apparatus according claim 9 wherein said securing means includes a detachable coupling which has two separable parts which are connected to opposite ends of said transverse member.

12. A lightweight, compact and portable apparatus according claim 1 wherein said opening is elongated, and the closing means includes an elongated member which is attached to one of the panels and extends along the opening.

13. A lightweight, compact and portable apparatus for stationary swimming exercises, comprising:

a manually collapsible bag which is formed of flexible sheet material for containing a volume of water;

said apparatus, when said bag is collapsed, dry and empty, having a weight which is no greater than 32 ounces and a volume which is no greater than 0.25 cubic feet;

a tether line having a forward portion which is connectable to a swimmer and a rear portion which is connected to said bag;

said collapsible bag having at least two panels which are opposed to each other and form an interior chamber for holding a quantity of water, an elongated opening for filling the chamber with water and for draining water from the chamber, and closing means for closing said opening to prevent water from flowing through said opening when said chamber contains water;

said closing means including an elongated member which is attached to one of said panels and extends along the opening.

14. A lightweight, compact and portable apparatus according to claim 13 wherein said bag has a forward end to which said tether line is connected, said forward end of the bag having two laterally spaced connection points to which said tether line is connected.

15. A lightweight, compact and portable apparatus according to claim 14 having a bridle to which said tether line is connected, said bridle having opposite ends connected to said connection points.

16. A method of conducting tethered swimming exercise utilizing a compact, lightweight and manually collapsible bag which has an interior chamber for containing a volume of water, and an opening for filling the chamber with water, said method comprising the following steps:

immersing said bag in a swimming pool so that water from the swimming pool flows through said opening and into said chamber of the bag;

closing the opening of the bag to retain the water in said chamber;

removing the bag from the pool;

attaching spaced portions of a tether line to the bag and to a swimmer;

swimming in the pool while being restrained by said tether line and said bag;

draining the water from the bag, and;

collapsing said bag to facilitate its portability.

17. A method according to claim 16 wherein said opening of the bag is elongated and is provided with an elongated closing member, and said step of closing the bag is performed by using the elongated closing member.

18. A lightweight, compact and portable apparatus for stationary swimming exercises, comprising:

a manually collapsible bag which is formed of flexible waterproof sheet material for containing a volume of water;

a tether line having a forward portion which is connectable to a swimmer and a rear portion which is connected to said bag;

said collapsible bag having at least two panels which are opposed to each other and form an interior chamber for holding a quantity of water, an opening for filling the chamber with water and for draining water from the chamber, and closing means for closing said opening to prevent water from flowing through said opening when said chamber contains water, said bag being formed of a material which has a higher coefficient of static friction when it is wet than when it is dry.

19. A lightweight, compact and portable apparatus for stationary swimming exercises, comprising:

a manually collapsible bag which is formed of flexible waterproof sheet material for containing a volume of water;

a tether line having a forward portion which is connectable to a swimmer and a rear portion which is connected to said bag;

said collapsible bag having at least two panels which are opposed to each other and form an interior chamber for holding a quantity of water, an opening for filling the chamber with water and for draining water from the chamber, and closing means for closing said opening to prevent water from flowing through said opening when said chamber contains water, said closing means including a transverse member which is attached to one of said panels and extends transversely across the bag, said bag having a rollable portion near said opening which is rollable around said member to form a closure roll which closes said opening.

20. A lightweight, compact and portable apparatus according to claim 19 including securing means for preventing said closure roll from unrolling.

21. A lightweight, compact and portable apparatus according to claim 20 wherein said securing means includes a detachable coupling which has two separable parts which are connected to opposite ends of said transverse member.

22. A lightweight, compact and portable apparatus for stationary swimming exercises, comprising:

a manually collapsible bag which is formed of flexible waterproof sheet material for containing a volume of water;

a tether line having a forward portion which is connectable to a swimmer and a rear portion which is connected to said bag;

said collapsible bag having at least two panels which are opposed to each other and form an interior chamber for holding a quantity of water, an elongated opening for filling the chamber with water and for draining water from the chamber, and closing means for closing said opening to prevent water from flowing through said opening when said chamber contains water, said closing means including an elongated member which is attached to one of the panels and extends along the opening.

* * * * *